US009915415B2

(12) United States Patent
Tsai

(10) Patent No.: US 9,915,415 B2
(45) Date of Patent: Mar. 13, 2018

(54) LAMP WITH 3D IMAGE DISPLAY

(71) Applicant: Tsung-Han Tsai, New Taipei (TW)

(72) Inventor: Tsung-Han Tsai, New Taipei (TW)

( * ) Notice: Subject to any disclaimer, the term of this patent is extended or adjusted under 35 U.S.C. 154(b) by 0 days.

(21) Appl. No.: 15/235,503

(22) Filed: Aug. 12, 2016

(65) Prior Publication Data

US 2018/0045398 A1 Feb. 15, 2018

(51) Int. Cl.

| | |
|---|---|
| ***F21V 1/00*** | (2006.01) |
| ***F21V 17/08*** | (2006.01) |
| ***F21V 3/02*** | (2006.01) |
| ***F21V 21/06*** | (2006.01) |
| ***F21V 23/00*** | (2015.01) |
| ***F21V 3/04*** | (2018.01) |
| ***F21S 6/00*** | (2006.01) |
| *F21Y 115/10* | (2016.01) |

(52) U.S. Cl.

CPC ..... *F21V 17/08* (2013.01); *F21S 6/002* (2013.01); *F21V 1/00* (2013.01); *F21V 3/02* (2013.01); *F21V 3/0472* (2013.01); *F21V 21/06* (2013.01); *F21V 23/002* (2013.01); *F21Y 2115/10* (2016.08)

(58) Field of Classification Search

CPC ..... F21S 6/002

See application file for complete search history.

(56) References Cited

U.S. PATENT DOCUMENTS

| | | | | |
|---|---|---|---|---|
| 2,945,948 | A * | 7/1960 | Maffei | F21S 6/002 362/228 |
| 3,025,392 | A * | 3/1962 | Worth | F21S 6/002 285/302 |
| 2004/0240212 | A1* | 12/2004 | Swanson | F21S 6/002 362/363 |
| 2006/0002118 | A1* | 1/2006 | Lin | F21S 6/002 362/412 |
| 2012/0056542 | A1* | 3/2012 | Hu | F21V 29/70 315/113 |
| 2016/0238235 | A1* | 8/2016 | Garrett | F21V 33/0052 |

* cited by examiner

*Primary Examiner* — Sean Gramling

(74) *Attorney, Agent, or Firm* — Rosenberg, Klein & Lee

(57) ABSTRACT

A lamp structure has a film-coated glass tube fixed by a body and a fixing element. The film-coated glass tube has 3D images film-coated on an inner wall for projection. A hollow tube passing through the film-coated glass tube is connected to a lighting bulb at a top thereof and has a projecting bulb connected in a middle section thereof for projection on the film-coated glass tube. Thereby the present invention is able to display 3D images by projection with a strongly fixed structure of the film-coated glass tube.

3 Claims, 7 Drawing Sheets

LAMP WITH 3D IMAGE DISPLAY

BACKGROUND OF THE INVENTION

1. Field of the Invention

The present invention relates to a lamp structure, particularly to one that has a glass tube film-coated with images to display 3D visual effects by projection.

2. Description of the Related Art

Lamps are designed for indoor illumination. Usually they are placed on desks, hallways, and corners to maximize its lighting function. Nowadays they have already become an essential part in our daily life. Consequently, their appearances have also come into our sights. The manufacturers have put great efforts to pursue different appearances and styles based on the basic structures of lamps, trying to become more competitive in the fields. However, these days lamps with different designs on the appearances in the markets tend to be considered normal without any creativity.

Glass tubes with 3D images are recently developed artworks. Various 3D images are coated on an inner wall of the glass tubes, allowing which to display vivid visual effects by simple projection; but there is a shortcoming—glass tubes are fragile, making it easily broken when engaged with other structures. Therefore, the inventor is trying to overcome the problem in order to combine the unique visual effects from the glass tubes with lamps structures.

SUMMARY OF THE INVENTION

A primary object of the present invention is to provide a lamp structure that is able to stably fix a film-coated glass tube on a supporting element and meanwhile display 3D images by projections for lighting and displaying special visual effects at the same time.

To achieve the objects mentioned above, the present invention comprises a base including a supporting element thereon and an axial through hole arranged from the supporting element through the base; a film-coated glass tube disposed on the supporting element with an opening on a top thereof, a bottom surface and a through hole at a bottom thereof, and an inner space therein, said film-coated glass tube further having 3D images on an inner wall thereof; an engaging device including a body and a fixing element, said body having a bowl-shaped bottom and a penetrating hole to be engaged in the supporting element, aligning the penetrating hole with the axial through hole; the bottom surface of the film-coated glass tube is fixedly disposed between the body and the fixing element, thereby further fixing the film-coated glass tube on the supporting element; a cover disposed on the film-coated glass tube; a hollow tube connecting from a top of the cover down through the film-coated glass tube to a bottom of the base and being fixed by a wing nut for a first wire to be connected to the cover therethrough; a projection bulb engaged a first bulb holder which is linked to the hollow tube in a middle section thereof and connected to the first wire, so as to project lights on the film-coated glass tube; and a lighting bulb engaged a second bulb holder on the cover which is connected to the first wire for illumination.

Furthermore, the projection bulb is a LED bulb for the purpose of energy saving and longer durability of the bulb. A lampshade is further disposed on the lighting bulb and the second bulb holder; with different design of the lampshade, the lamp is able to present different styles for decoration.

In an embodiment, the hollow tube is formed by a first tube linked to a second tube with a connecting section, said second tube having a second external threaded section at a bottom thereof for the wing nut to fixedly screw under a bottom of the base and said connecting section being electrically connected to the first bulb holder via a second wire.

In another embodiment, the hollow tube is formed by a first tube linked to a second tube with a connecting section and a third tube engaged with the second tube, said third tube having a fourth external threaded section at a bottom thereof for the wing nut to fixedly screw under a bottom of the base and said connecting section being electrically connected to the first bulb holder via a second wire, the body further including an inner flange for fixed engaging the third tube thereon by a positioning ring and a nut.

With structures disclosed above, the present invention has the engaging device to stably fix the film-coated glass tube on the supporting element to prevent from breakage of the glass tube. Also, the glass tube has 3D images coated on the inner wall to produce beautiful visual effects by projection while lighting up the surrounding area.

DETAILED DESCRIPTION OF THE PREFERRED EMBODIMENT

Figure 1:
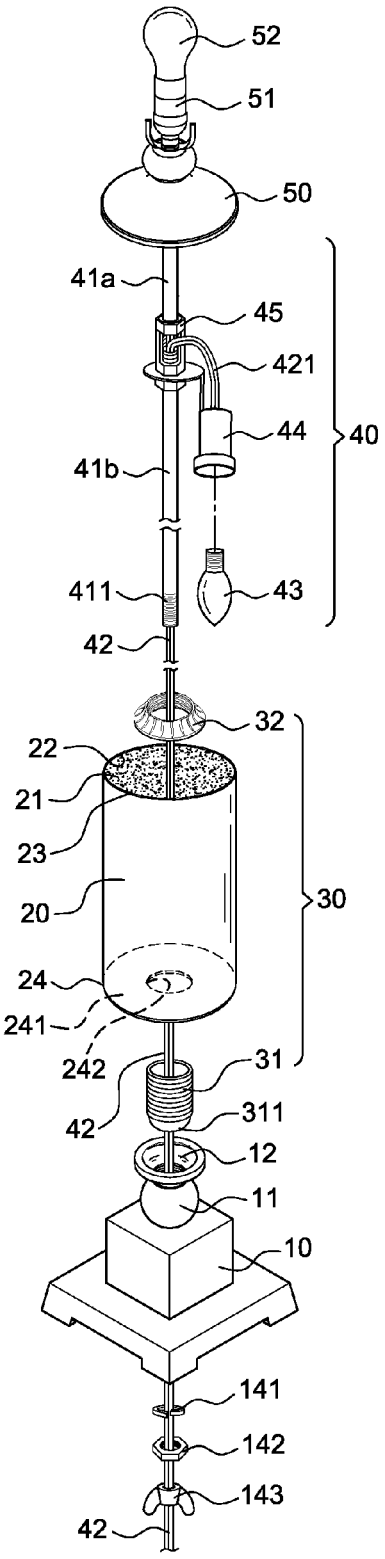
FIG. 1 is an exploded view of the present invention in an embodiment.
Figure 2:
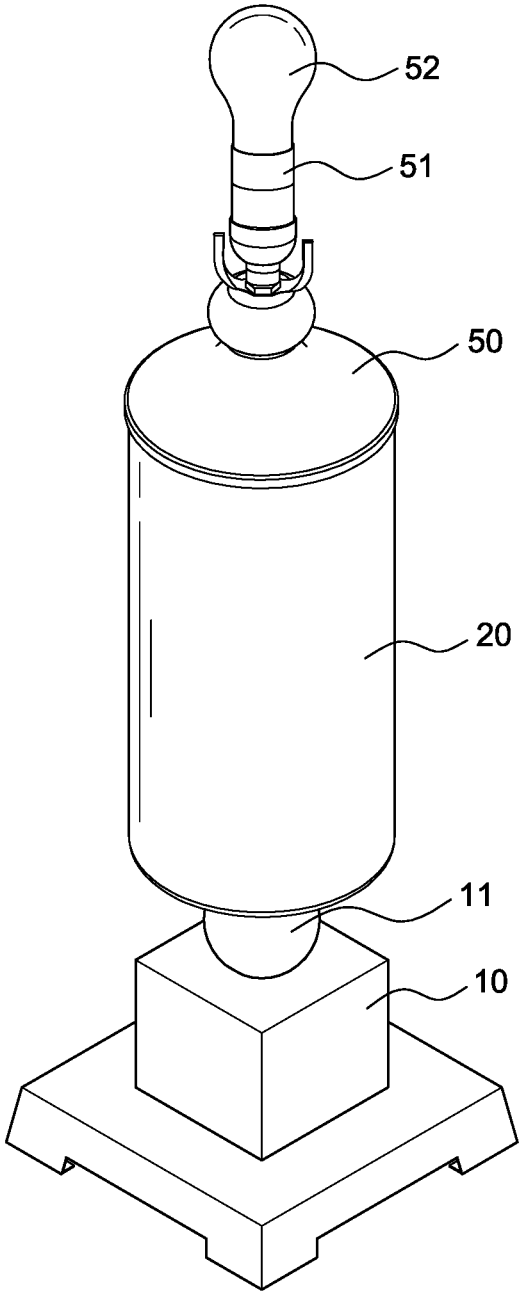
FIG. 2 is a perspective view of the present invention in the embodiment.

Referring to FIGS. 1-3A, in an embodiment, the present invention mainly comprises a base 10, a film-coated glass tube 20, an engaging device 30, a hollow tube 40, and a cover 50.

The base 10 includes a supporting element 11 thereon and an axial through hole 12 arranged from the supporting element 11 through the base 10.

The film-coated glass tube 20 is disposed on the supporting element 11 with an opening 23 on a top thereof, a bottom surface 241 and a through hole 242 at a bottom thereof, and an inner space 21 therein. The film-coated glass tube 20 further has 3D images on an inner wall 22 thereof.

The engaging device 30 includes a body 31 and a fixing element 32. The body 31 has a bowl-shaped bottom 311 and a penetrating hole 312 to be engaged in the supporting element 11, aligning the penetrating hole 312 with the axial through hole 12. The bottom surface 241 of the film-coated glass tube 20 is fixedly disposed between the body 31 and the fixing element 32, thereby further fixing the film-coated glass tube 20 on the supporting element 11.

The cover 50 is disposed on the opening 23 of the film-coated glass tube 20. The hollow tube 40 is formed by a first tube 41*a* linked to a second tube 41*b* with a connecting section 45. The first tube 41*a* is linked to a top end of the cover 50, and the second tube 41*b* has a second external threaded section 411 at a bottom thereof and passes through the film-coated glass tube 20 to a bottom of the base 10 to be screwed and fixed by a spring washer 141, a plain washer 142 and a wing nut 143. The cover 50 is further connected to a first wire 42 which passes through the hollow tube 40 to a bottom of the base 10. A projection bulb 43 and a first bulb holder 44 are arranged in the inner space 21 of the film-coated glass tube 20 and linked to the hollow tube 40 in a middle section thereof, connected to the first wire 42 via a second wire 421 for projection; in this embodiment, the projection bulb 43 is a LED bulb. A lighting bulb 52 and a second bulb holder 51 are disposed on the cover 50 and connected to the first wire 42 for illumination.

Figure 3:
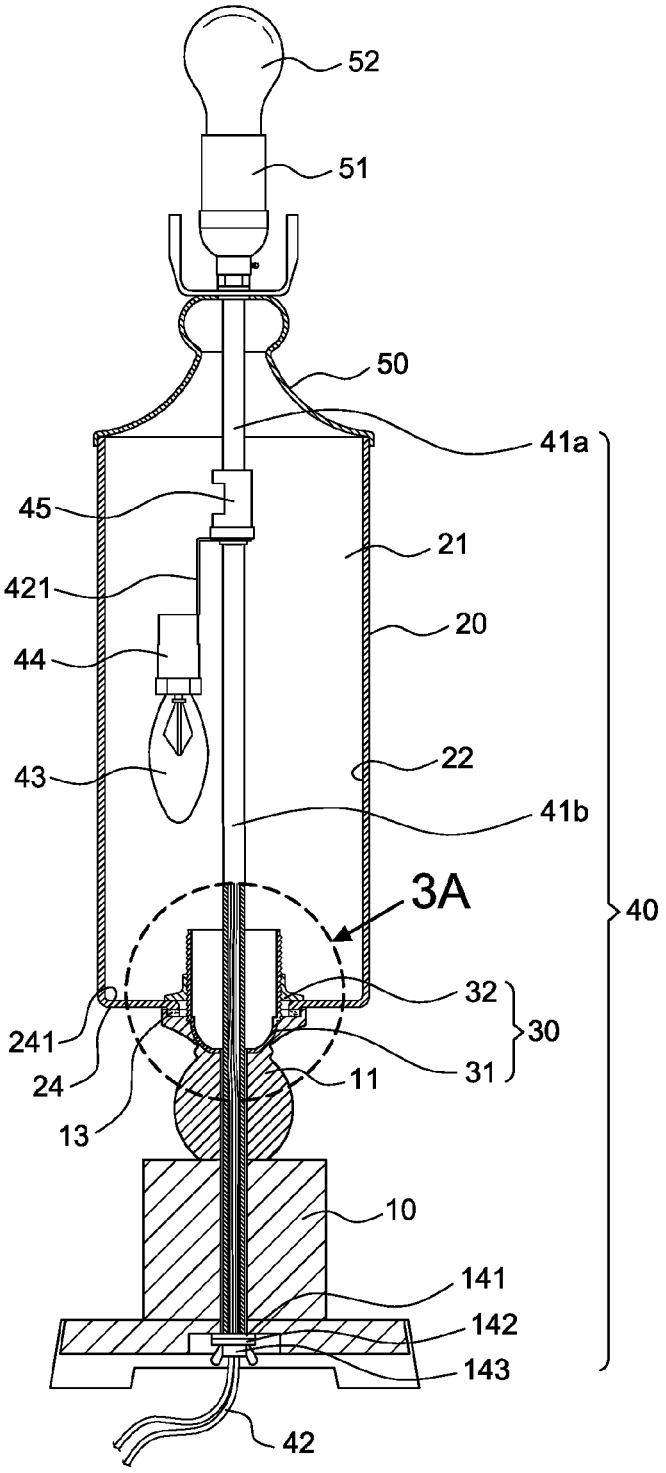
FIG. 3 is a sectional view of the present invention in the embodiment.
Figure 3A:
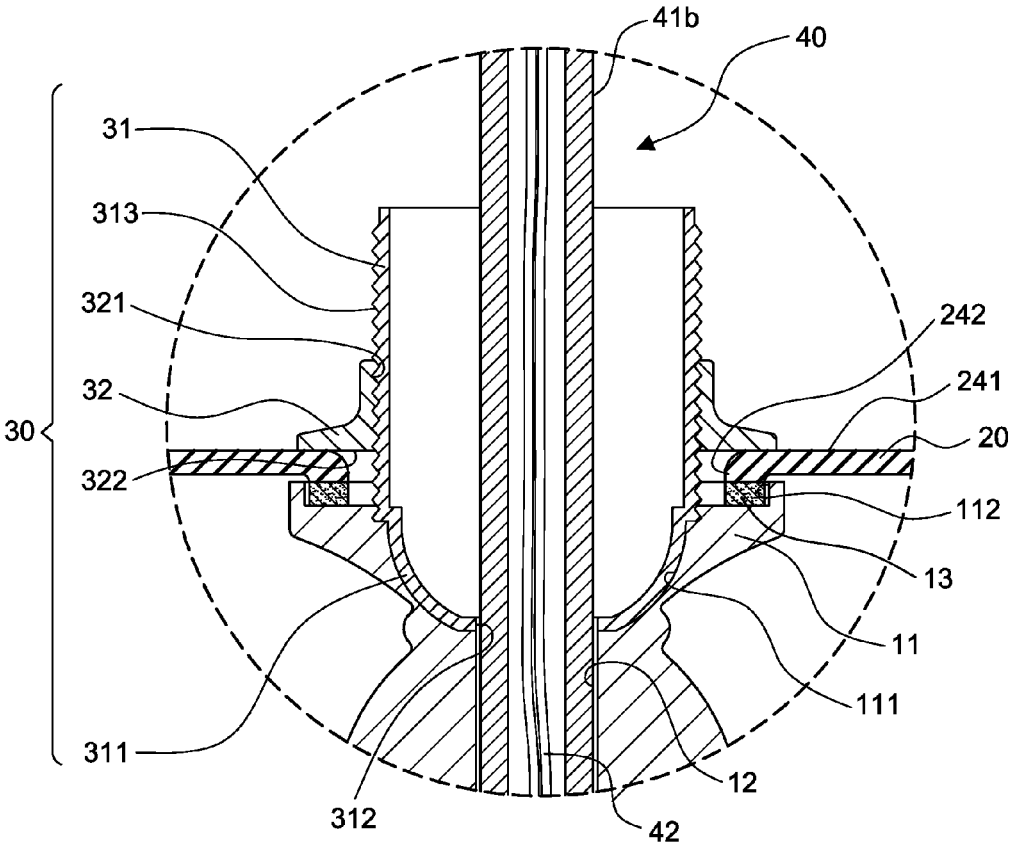
FIG. 3A is an enlarged view of area 3A in FIG. 3.

FIG. 3A shows structures of the engaging device 30 in an embodiment. The bowl-shaped bottom 311 of the body 31 is disposed in a positioning hole 111 of the supporting element 11, aligning the penetrating hole 312 with the axial through hole 12. The supporting element 11 further includes a rubber ring 13 disposed on a protruding flange 112 thereof, and the bottom surface 241 of the film-coated glass tube 20 is disposed on the supporting element 11; the fixing element 31 has a first internal threaded section 321 screwed with a first external threaded section 313 of the body 31 to ensure a bottom 322 of the fixing element 32 is fixedly disposed on the bottom surface 241 of the film-coated glass tube 20. The film-coated glass tube 20 is thereby secure with the engagement and the rubber ring 13, thus avoiding the risks of breakage of the fragile glass material.

Figure 4:
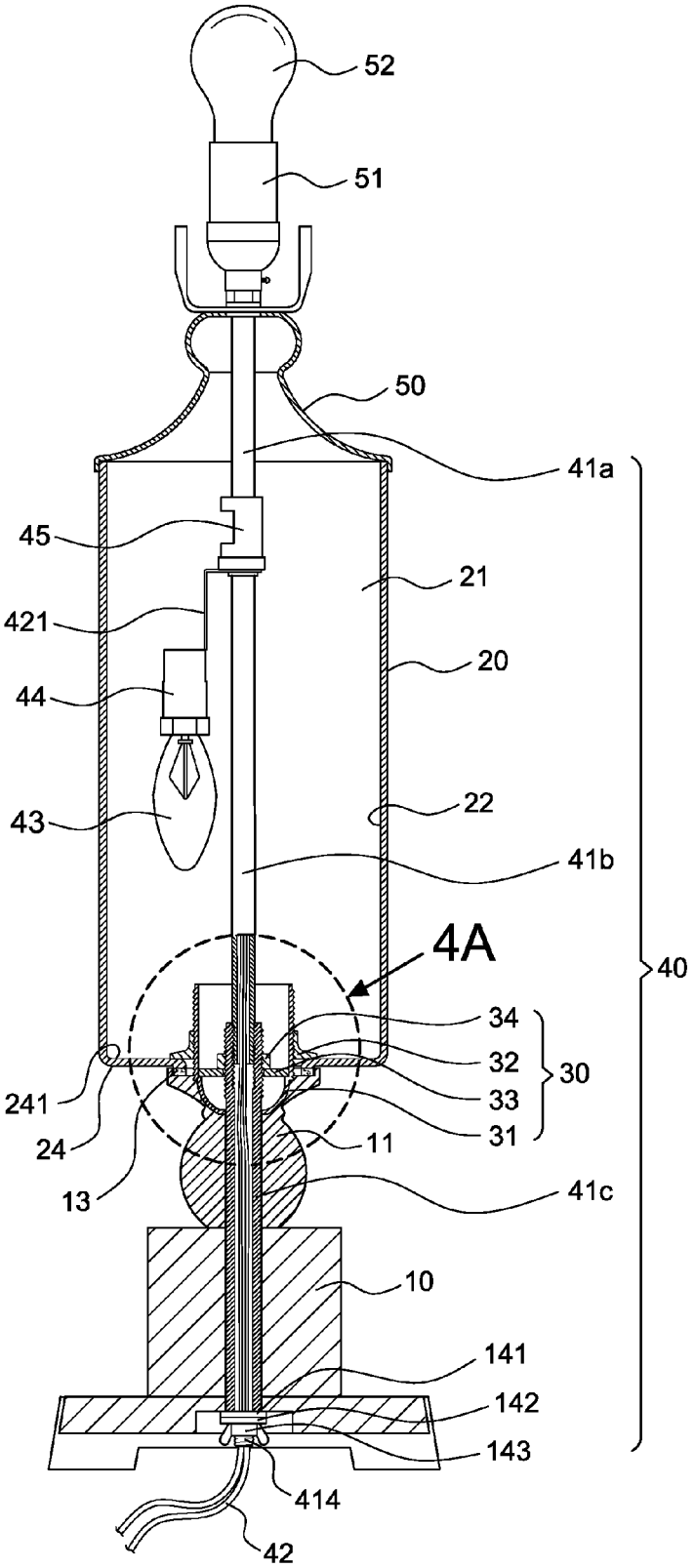
FIG. 4 is a sectional view of the present invention in another embodiment.

FIG. 4 illustrates another embodiment of the present invention. In the embodiment, the hollow tube 40 is formed by a first tube 41*a* linked to a second tube 41*b* with a connecting section 45 and a third tube 41*c* engaged with the second tube 41*b*. The first tube 41*a* is linked to a top end of the cover 50, and the second tube 41*b* and the third tube 41*c* pass through the film-coated glass tube 20 to a bottom of the base 10. The third tube 41*c* has a fourth external threaded section 414 at a bottom thereof to be screwed and fixed by a spring washer 141, a plain washer 142 and a wing nut 143 under the bottom of the base 10. The cover 50 is further connected to a first wire 42 which passes through the hollow tube 40 to the bottom of the base 10. A projection bulb 43 and a first bulb holder 44 are arranged in the inner space 21 of the film-coated glass tube 20 and linked to the hollow tube 40 in a middle section thereof, connected to the first wire 42 via a second wire 421 for projection; in this embodiment, the projection bulb 43 is a LED bulb. A lighting bulb 52 and a second bulb holder 51 are disposed on the cover 50 and connected to the first wire 42 for illumination. In addition, the body 31 is further fixed on the supporting element 11 by engagement of a positioning ring 33 and a nut 34 with the third tube 41*c*.

Figure 4A:
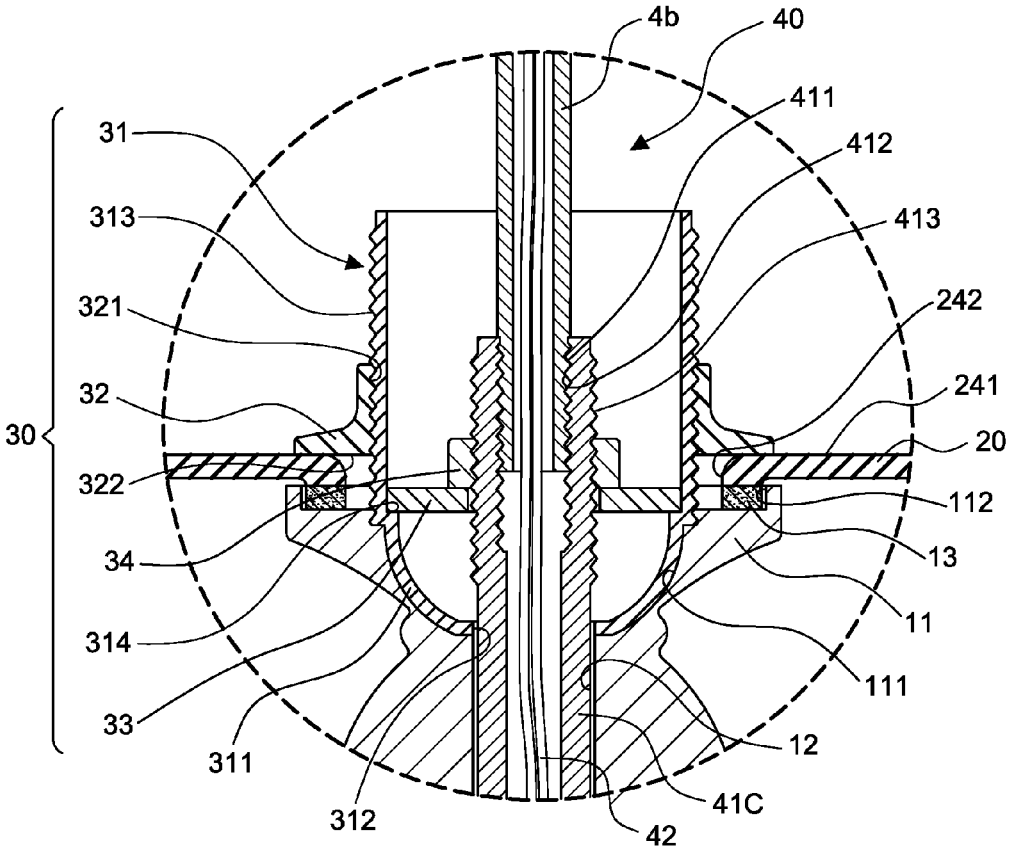
FIG. 4A is an enlarged view of area 4A in FIG. 4.

In FIG. 4A, the structure of the engaging device 30 is further illustrated. The second tube 41*b* has a second external threaded section 411 screwed with a second internal threaded section 412 at an end of the third tube 41*c* to link up the second tube 41*b* and the third tube 41*c*. The third tube 41*c* further has a third external threaded section 413 screwed through the positioning ring 33 on an inner flange 314 formed within the body 31 and fixed by a nut 34 to securely place the body 31 on the supporting element 11. The bowl-shaped bottom 311 of the body 31 is disposed in a positioning hole 111 of the supporting element 11, aligning the penetrating hole 312 with the axial through hole 12. The supporting element 11 further includes a rubber ring 13 disposed on a protruding flange 112 thereof, and the bottom surface 241 of the film-coated glass tube 20 is disposed on the supporting element 11; the fixing element 31 has a first internal threaded section 321 screwed with a first external threaded section 313 of the body 31 to ensure a bottom 322 of the fixing element 32 is fixedly disposed on the bottom surface 241 of the film-coated glass tube 20. The film-coated glass tube 20 is thereby secure with the engagement and the rubber ring 13, thus avoiding the risks of breakage of the fragile glass material.

Figure 5:
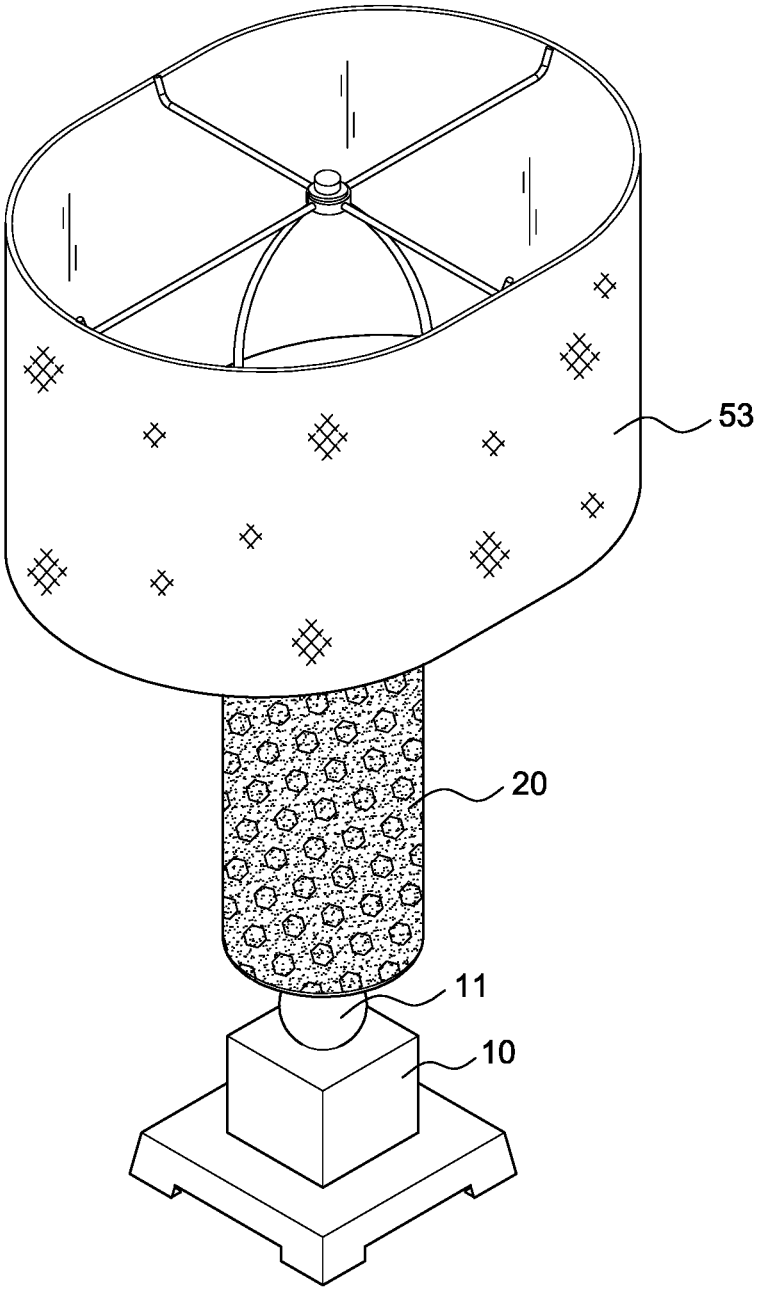
FIG. 5 is a perspective view of the present in another embodiment.

FIG. 5 shows another embodiment of the present invention. In the embodiment a lampshade 53 is further disposed on the lighting bulb 52 and the second bulb holder 51. With different designs of the lampshade 53, the lamp is able to present in various appearances.

In short, the present invention has the engaging device 30 to stably fix the film-coated glass tube 20 on the supporting element 11 to prevent from breakage of the glass tube. Also, the glass tube has 3D images coated on the inner wall to produce beautiful visual effects by projection while lighting up the surrounding area, and it is applicable with different lampshades for different styles and appearances.

Although particular embodiments of the invention have been described in detail for purposes of illustration, various modifications and enhancements may be made without departing from the spirit and scope of the invention. Accordingly, the invention is not to be limited except by the appended claims.

What is claimed is:

1. A lamp with 3D image display, comprising:

a base including a supporting element thereon and an axial through hole arranged from the supporting element through the base;

a film-coated glass tube disposed on the supporting element with an opening on a top thereof, a bottom surface and a through hole at a bottom thereof, and an inner space therein, said film-coated glass tube further having 3D images on an inner wall thereof;

an engaging device including a body and a fixing element, said body having a bowl-shaped bottom and a penetrating hole to be engaged in the supporting element, aligning the penetrating hole with the axial through hole; the bottom surface of the film-coated glass tube is fixedly disposed between the supporting element and the fixing element, thereby further fixing the film-coated glass tube on the supporting element;

a cover disposed on the film-coated glass tube;

a hollow tube connecting from a top of the cover down through the film-coated glass tube to a bottom of the base and being fixed by a wing nut for a first wire to be connected to the cover therethrough, the hollow tube being formed by a first tube linked to a second tube with a connecting section and a third tube engaged with the second tube, said third tube having an external threaded section at a bottom thereof for the wing nut to fixedly screw under a bottom of the base and, the body further including an inner flange for fixed engaging the third tube thereon by a positioning ring and a nut;

a projection bulb engaged with a first bulb holder which is linked to the hollow tube in a middle section thereof and connected to the first wire, so as to project lights on the film-coated glass tube, said connecting section being electrically connected to the first bulb holder via a second wire; and a lighting bulb engaged a second bulb holder on the cover which is connected to the first wire for illumination.

2. The lamp with 3D image display as claimed in claim 1, wherein the projection bulb is a LED bulb.

3. The lamp with 3D image display as claimed in claim 1, wherein a lampshade is further disposed on the lighting bulb and the second bulb holder thereof.

* * * * *